United States Patent [19]

LaCourse

[11] Patent Number: 4,581,614

[45] Date of Patent: Apr. 8, 1986

[54] INTEGRATED MODULAR PHASED ARRAY ANTENNA

[75] Inventor: Yvon R. LaCourse, Whitesboro, N.Y.

[73] Assignee: General Electric Company, Syracuse, N.Y.

[21] Appl. No.: 515,074

[22] Filed: Jul. 18, 1983

[51] Int. Cl.[4] ..... H01Q 13/10; H01Q 3/30

[52] U.S. Cl. ..... 343/368; 343/768; 343/771

[58] Field of Search ..... 343/368, 371, 767, 768, 343/770, 771

[56] References Cited

U.S. PATENT DOCUMENTS 3,220,007 11/1965 Thourel ..... 343/771

*Primary Examiner*—Eli Lieberman

*Attorney, Agent, or Firm*—Carl W. Baker; Richard V. Lang

[57] ABSTRACT

A modular integrated multi-element phased array antenna. The antenna is comprised of a supporting structure having a plurality of slotted, ridged waveguide radiator elements longitudinally extending therein and a single series ridged waveguide feed structure, having a first and second plurality of waveguide channels formed therein. The feed structure is supported by at least a portion of the supporting structure and receives microwave energy from a source and then couples the energy to the first plurality of waveguide channels. The antenna is further comprised of a multi-element phase shifter module positioned in juxtaposition with the feed structure for receiving the microwave energy from each of the first plurality of waveguide channels. The phase shifted energy is coupled from the phase shifter module to each of the second plurality of waveguide channels. Means is also provided for coupling the phase shifted energy from each of the second plurality of waveguide channels to each of the waveguide radiator elements, whereby the phase shifted energy in the form of a desired microwave beam pattern is transmitted from the radiator elements to a desired location.

9 Claims, 8 Drawing Figures

INTEGRATED MODULAR PHASED ARRAY ANTENNA

BACKGROUND OF THE INVENTION

1. Field Of The Invention

The present invention relates generally to microwave systems, and more particularly to phased array antennas of the multichannel type having a plurality of radiating apertures.

2. Description Of The Prior Art

Generally, phased array antennas are used in either a ground, airborne or space application. The prior art phased array antenna is comprised of a plurality of separate radiating elements each of which performs identical electrical functions. Each radiating element includes a microwave feed with couplers to distribute the required microwave power to each element, phase shifters to change the radiated energy phase as required for antenna beam position, drive circuitry to power the phase shift component, logic circuitry to provide phase shifter/driver steering information, and a microwave radiator to shape and disseminate the microwave energy. Each of these functions must be repeated for each phased array antenna element required to form the complete antenna. Prior antenna designs which incorporate these separate functions for each required radiating element are expensive, heavy, and unreliable because of several thousand critical microwave, logic, and DC required. Furthermore, the integration of these separate functions in the conventional manner requires individual structures, heat sinking and electrical interconnections for each function. As a result, the weight, cost and maintainability requirements of existing designs make the phased array antenna highly impractical.

Therefore, it is an object of the present invention to provide a phased array antenna which requires minimum individual structures, a minimum number of heat sinks and a minimum number of electrical connections for each antenna function.

It is another object of the present invention to provide a phased array antenna in the form of an integrated modular design which minimizes both electrical and mechanical interfaces and results in a low cost, lightweight assembly.

BRIEF DESCRIPTON OF THE DRAWINGS

Figure 2:
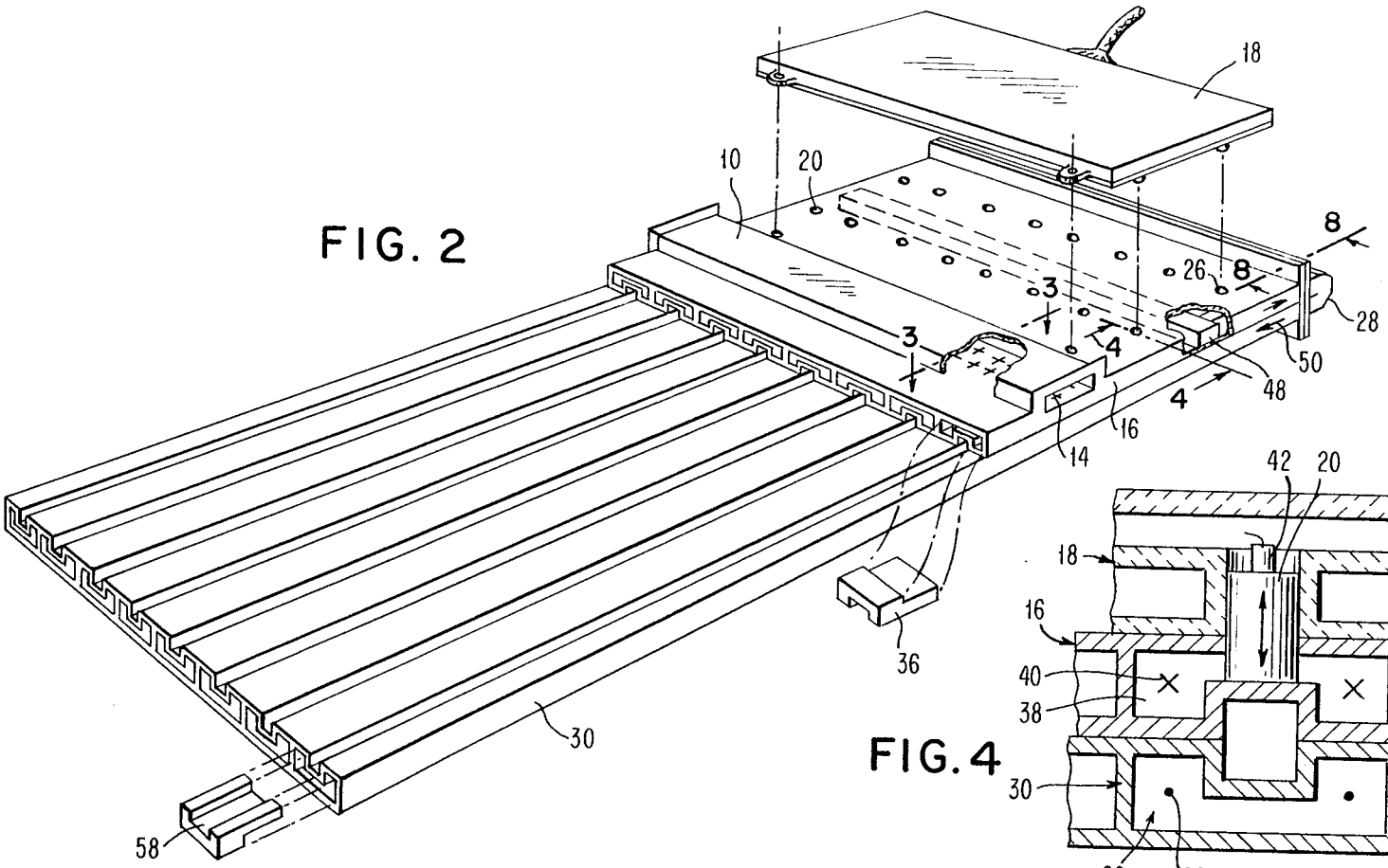
FIG. 2 is a partially expolded perspective view of an eight element module subarray of the phased array antenna in assembled form with some portions partially cut away.
Figure 8:
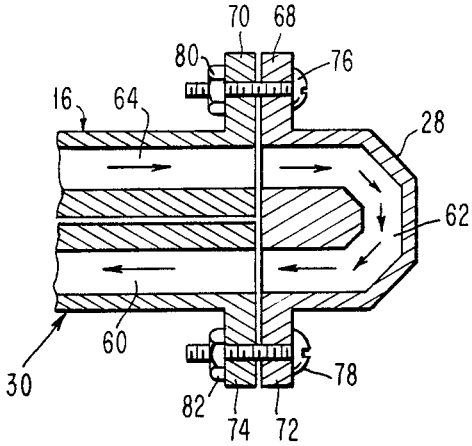
Figure 7:
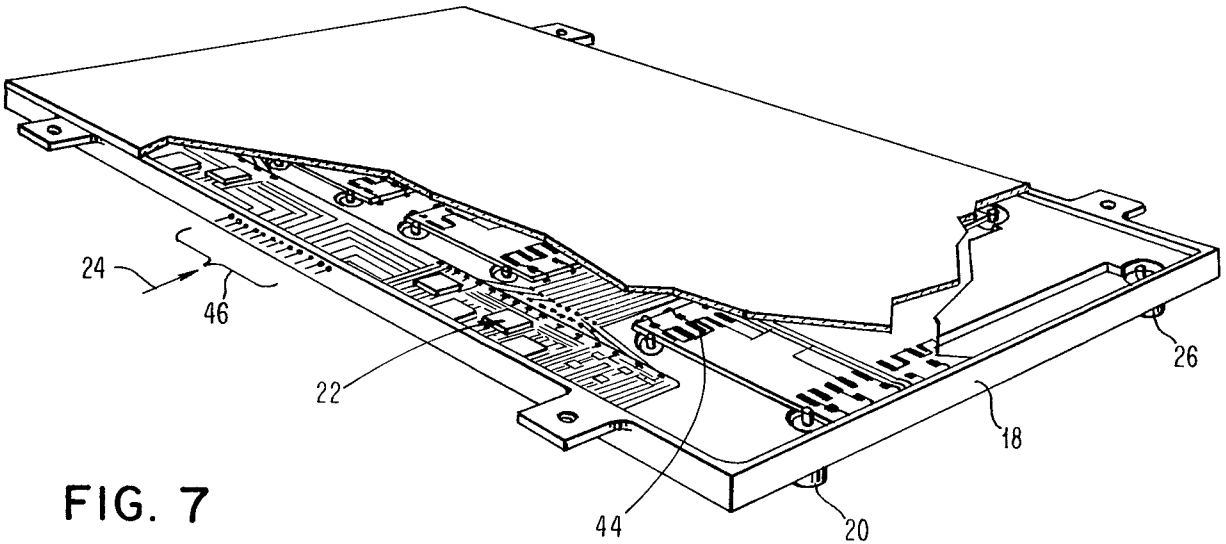

FIG. 7 is a perspective view, partially broken away, of the microelectronic phase shifter module which is mounted in juxtaposition to and on the secondary arm of the integrated modular phased array antenna shown in FIG. 2; and FIG. 8 is an enlarged partial cross sectional view taken along line 8—8 in FIG. 2 showing that part of the antenna subarray comprised of the 180° waveguide bend coupled to the secondary arm and the radiating waveguide.

SUMMARY OF THE INVENTION

The subject invention provides a modular integrated phased array antenna which generally includes a plurality of ridged waveguides for receiving and transmitting microwave energy. The assembled modular antenna in accordance with the invention is comprised of a ridged waveguide support structure, a primary arm for receiving the microwave energy, a multi-element secondary arm coupled to receive energy from the primary arm, and a multi-element (phase shifter) module which contains driver and phase shifter circuitry, which multi-element module is positioned in juxtaposition with the secondary arm. Input probes couple the microwave energy from the secondary arm to individual elements of the phase shifter. Individual output probes connect the output of respective elements of the phase shifter back to the secondary arm, where a 180° waveguide bend causes the energy to be directed into the support structure which forms a multi-element radiating waveguide. The microwave energy is radiated out from each radiator element through slots in its bottom wall. The slots are so dimensioned and positioned to generate a beam at each radiator element, the integration of which forms a desired microwave beam pattern which is transmitted to a desired location.

DESCRIPTION OF THE PREFERRED EMBODIMENT

Figure 1:
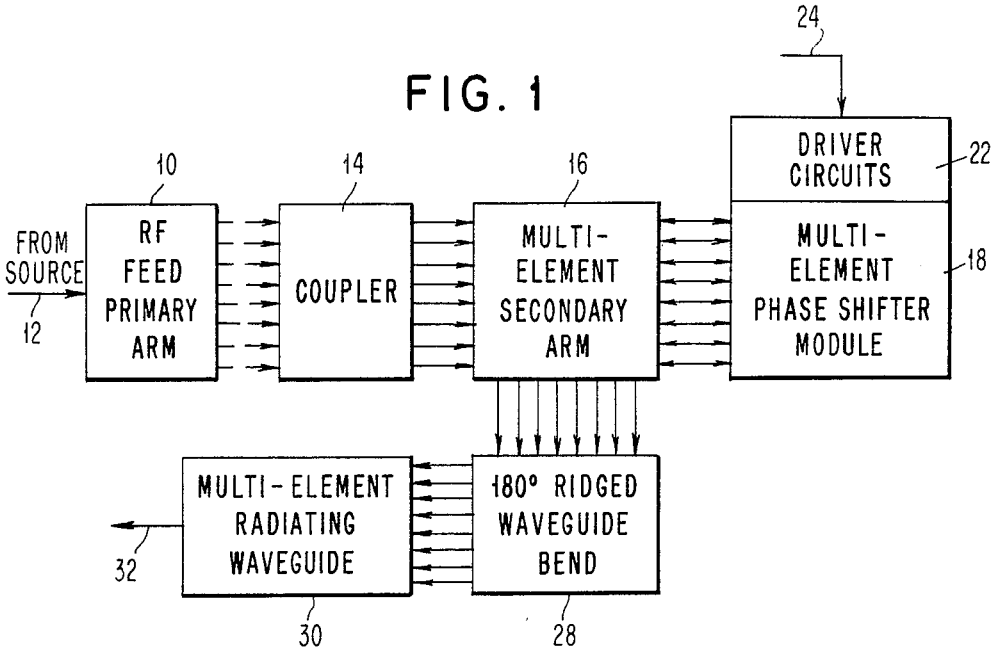
FIG. 1 is a functional block diagram of the electrical system function of the integrated modular phased array antenna illustrative of the present invention.

Referring to FIG. 1, there is shown a functional block diagram of a phased array antenna in accordance with the present invention, which includes a single series RF feed or primary arm 10 that receives RF microwave energy from a source, not shown, along an input line 12. The RF energy is coupled from primary arm 10 via coupling means 14 (shown in FIG. 3) to a multi-element secondary arm 16. It is to be understood that, while a phased array antenna having eight elements is shown in the drawings and described herein, the modular concepts described herein also apply to any other suitable number of elements. Physically, the phased array antenna is modularized and may consist of a plurality of subarrays, with each subarray containing the multiple elements shown herein.

Figure 4:
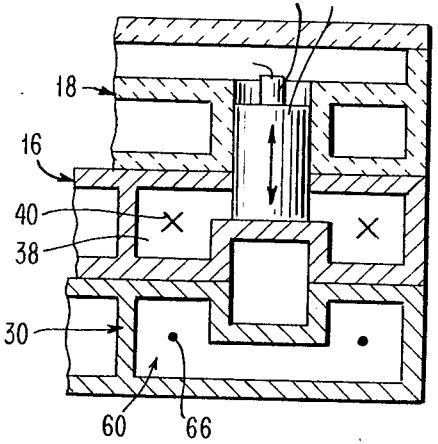
FIG. 4 is a sectional view taken along line 4—4 in FIG. 2 showing an RF input probe extending between an element of the secondary arm and an element of the phase shifter module.

The RF energy proceeds from each element of secondary arm 16 to a respective element of a microelectronic phase shifter module 18 via respective input probes 20, shown in FIG. 4, which extend between phase shifter module 18 and secondary arm 16. Preferably, phase shifter module 18 is of the diode phase shifter type wherein diodes within a phase shifter element are selectively turned on and off by respective driver circuits 22 in accordance with the desired beam position as determined from information received on line 24 from a beam steering controller, not shown. As will be shown more specifically in subsequent figures, phase shifter module 18 includes both driver circuits 22 and phase shifter circuits, and such module 18 is physically positioned in juxtaposition with secondary arm 16. The output of each element of phase shifter module 18 is connected by an output probe 26, identical to input probe 20 shown in FIG. 4, for coupling the phase shifted RF microwave energy associated with each element back to secondary arm 16. After the RF energy is returned to the secondary arm from phase shifter module 18, it immediately enters an integral 180° ridged waveguide bend 28, which couples the phase shifted RF energy into a multi-element radiating waveguide 30. The phase shifted energy is then radiated out from slots, shown in FIGS. 5 and 6, extending in the broad wall of waveguide 30 to form the required beam shape indicated by an output line 32.

Figure 3:
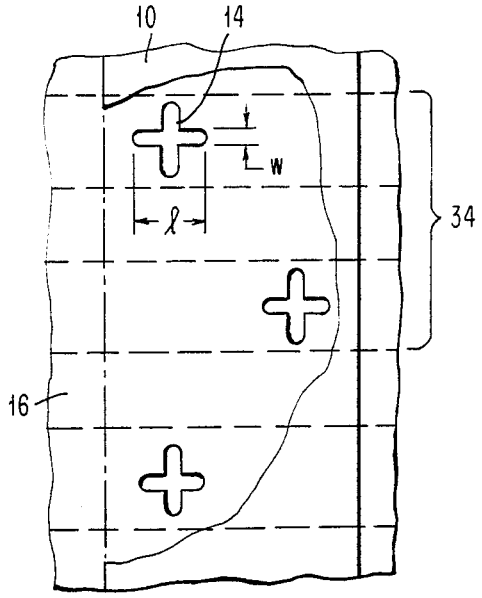
FIG. 3 is an exploded top view taken along line 3—3 in FIG. 2 showing the integrated waveguide cross-couplers for coupling microwave energy from the single series feed primary arm to each of the eight elements of the secondary arm.

Referring to FIG. 2, there is shown an exploded isometric view of an eight element modular phased array antenna of the type shown in block diagram in FIG. 1. It should be noted that while a single antenna section or subarray is shown in FIG. 2, the antenna may be composed of a plurality of such subarrays having eight elements, with each subarray being identical to the one shown in FIG. 2. Each identical modular subarray shown in FIG. 2 includes a single series feed structure for eight elements having the series feed primary arm 10 adjacent to the multielement secondary arm 16, with coupling of the RF feed between the primary and secondary arms being provided by coupling means 14 shown by the broken away section in FIG. 3. Coupling means 14 consists essentially of a series of passages cut in the cross-sectional shape of crosses extending from the channel formed by primary arm 10 into the wall of the multi-element secondary arm 16. As shown in FIG. 3, a pair of such coupling passages 14 can be employed for coupling microwave energy to each one of a first plurality of waveguide channels formed within secondary arm 16, each pair of such passages being indicated by the bracket 34. A typical width w of each leg of coupling passage 14 may be 0.020 inches, whereas a typical length l of such passage 14 may be about 0.80 inches.

Secondary arm 16 consists of eight elements comprised of a first and secondary plurality of waveguide channels having a U-shape indicated by a $\frac{3}{4}''$ long ferrite epoxy channel end plug 36 shown broken away in FIG. 2, which end plugs extend into the ends of each channel of the secondary arm and serve as the loads for the channels. Thus, the integrated waveguide cross couplers 14 direct the primary RF energy into the eight sections (i.e. a first plurality of waveguide channels) of secondary arm 16, wherefrom the energy is directed respectively to each of eight input probes 20 shown more specifically in FIG. 4. As shown in FIG. 4, with regard to the first plurality of waveguide channels, the channel for a single element of secondary arm 16 is indicated by numeral 38 with the numeral 40 indicating the direction of the energy in channel 38 at the location where the sectional view is taken. Each input probe 20 provides a matched impedance into a diode phase shifter circuit 44 in module 18. Each RF probe 20 may comprise a one-quarter inch diameter teflon sleeve around a 0.060 inch diameter copper wire 42. Input probe 20 connects the RF energy into diode phase shifter circuit 44, shown in FIG. 7 as being printed on a ceramic aluminum oxide substrate, which phase shifter circuit can be the same as the phase shifter and substrate disclosed in U.S. Pat. No. 4,254,383 issued to Allen R. Wolfe and assigned to General Electric Company, the same assignee as the assignee of the present invention. As indicated above, phase shifter circuit 44 is of the diode type, wherein the diodes are turned on and off in accordance with the desired beam position as determined from information received on input line 24 from the beam steering controller.

FIG. 7 also shows input/output pins 46 used for connecting phase shifter circuits 44 to the beam steering control input on line 24 and to the power supply, not shown. Also shown is the chip carrying driver circuits 22 and one of RF output probes 26 which is identical to the input probes. The circuitry on phase shifter module 18 is encased in a hermetically sealed carrier which provides protection from the environment and is thermally designed to permit low device functioning temperatures, thereby increasing its life and reliability. Also, the modular concept of the present invention affords an easily maintained array, wherein the individual modular sections can be easily replaced within the system, if required.

Referring again to FIG. 2, it can be seen that phase shifter module 18 is mounted and positioned in juxtaposition with secondary arm 16, wherein input and output probes 20 and 26 are in alignment with respective input and output terminals of the phase shifter and the respective first and second plurality of waveguide channels of secondary arm 16. Accordingly, the RF output probes will return the phase-changed energy from phase shifter module 18 to the second plurality of waveguide channels within secondary arm 16. An isolation wall 48 made of aluminum is shown by the broken away section of secondary arm 16. Isolation wall 48 extends along all eight elements of the secondary arm 16 and serves to electromagnetically isolate the RF microwave in the first plurality of energy waveguide channels from the phase shifted RF microwave energy in the second plurality of waveguide channels. The RF energy returning via output probes 26 from phase shifter 18 is directed from the second plurality of waveguide channels through the integral 180° bend 28 to radiating waveguide 30. Arrows 50 indicates the reversal in direction of such energy after exiting bend 28.

Figure 5:
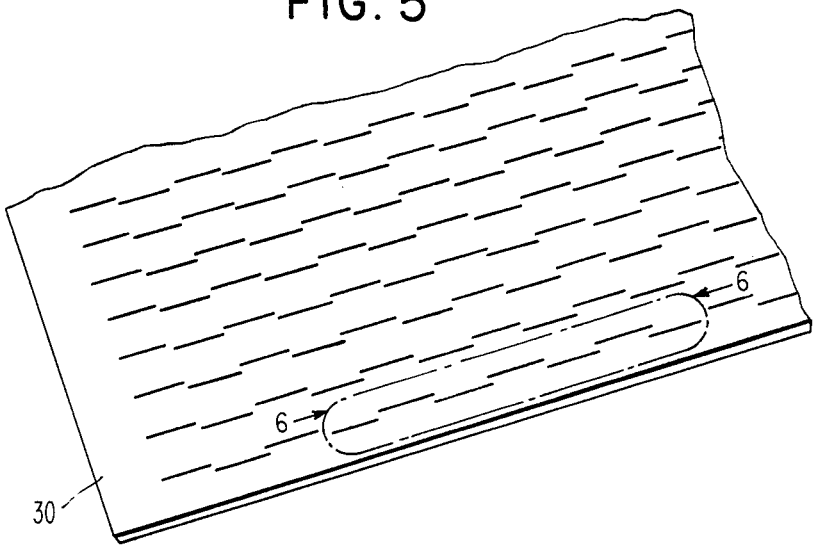
FIG. 5 shows a portion of the bottom of a multi-element radiating waveguide.
Figure 6:
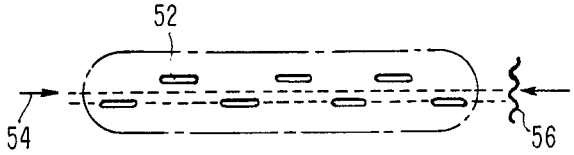
FIG. 6 is a blown-up view taken along parabolic line 6—6 in FIG. 5 showing a portion of the bottom of a waveguide radiating column showing part of a linear slot array.

FIG. 5 shows the bottom of radiating waveguide 30, and, more particularly shows a plurality of radiating apertures or slots 52 formed within each of the eight elements, which slots are so dimensioned and positioned as to generate a beam at each radiator element. More particularly, the radiating slots have a longitudinal shape and are appropriately spaced to provide lower cross-polarization components and an element pattern permitting ±60 degree scan. As shown in FIG. 6, the input to radiating slots 52 is indicated by arrow 54, and a terminating load is indicated by numeral 56. FIG. 2 shows a load element ferrite epoxy end plug 58 for one element of the radiating waveguide 30, which end plug is identical in size and shape to end plug 36. Although not shown, each element of radiating waveguide 30 has an end plug identical to end plug 58.

Referring to FIGS. 5 and 8, radiating waveguide 30 can be described as a supporting structure having a plurality of slotted, ridged waveguide radiator elements 60. Although FIGS. 5 and 8 show one radiator element and FIG. 8 shows one waveguide section 62 within integral 180° waveguide bend 28 and one waveguide channel 64 of the second plurality of waveguide channels, in the embodiment it is understood that there are eight radiator elements, eight waveguide sections and eight channels of the second plurality of waveguide channels. While the direction of the phase shifted RF microwave energy is indicated by numeral 66 in FIG. 4, the arrows in FIG. 8 shows the direction of the phase shifted microwave energy through one of the second plurality of wavguide channels 64, one of waveguide sections 62 of integral waveguide bend 28 and one of radiator elements 60. The shape and dimension of each waveguide section formed with waveguide bend 28 should be the same as its respective waveguide channel 64 and radiator element 60 to insure proper operation. As shown in FIG. 8, secondary arm 16 is in juxtaposition with and supported by radiating waveguide supporting structure 30. An upper flange portion 68 extending from the top of waveguide bend 28 is positioned adjacent a flange section 70 extending upward from secondary arm 16. A lower flange portion 72 extending from the bottom of waveguide bend 28 is positioned adjacent a flange section extending from the bottom of radiating waveguide supporting structure 30. Using bolts 76 and 78 and respective nuts 80 and 82, waveguide bend 28 can be fastened to secondary arm 16 and radiating waveguide supporting structure 30. At this point it should be mentioned that the primary and secondary arms, the radiating waveguide supporting structure and the integral 180° waveguide bend can be fabricated from any suitable electrically conducting material, such as aluminum.

The operation of the antenna subarray in the transmit mode is summarized by the following. The RF energy from the microwave source enters the single series feed primary arm 10 and is coupled to each of the eight sections of secondary arm 16 as required through the integrated waveguide cross couplers 14. The RF energy proceeds to the input of the phase shifters on module 18 via probes 20 which respectively protrude into the first plurality of waveguide channels in secondary arm 16. The energy goes through probes 20 into each diode phase shifter circuit 44 which changes the phase of the transmitted energy. The phase shifted energy is then returned to the second plurality of waveguide channels in secondary arm 16 via output RF probes 26, and travels to each slotted radiator element of radiating waveguide 30 via integral 180° waveguide bend 28. The phase shifted energy is radiated via slots 52 in the broadwall of each radiator element to form the required beam pattern to a desired location.

The subarray interconnections can be reduced to a minimum number, such as twelve, wire connections into the microelectronic module. All other interconnections are microelectronic wire bonds. The complete eight element subarray is sealed to prevent moisture collection in the waveguide. The sealing is achieved by using a gland between the phase shifter module and the feed, and a thin dielectric cover over the radiator. The RF loads for the feed and radiator functions are bonded in place to complete the seal.

To minimize fabrication costs, the entire waveguide assembly is dip brazed to form a single piece. The center portion of the assembly is a single aluminum extrusion to which pre-punched cover plates are placed. The entire assembly is then fixtured via weights and brazed. The brazing occurs via the usage of aluminum clad cover plates which eliminate the need for filler brazing material. Labor content is minimized in the integral subarray fabrication, therefore significantly reducing cost.

Thus, the present invention provides an advantageous integration of the required antenna functions through modular antenna subarrays, which are standalone phased array antennas within themselves. The major advantages of this modular integration of functions are that, via an integrated design concept, the resulting system weight is significantly reduced by utilizing individual functions and components for multipurposes. That is, the ridged waveguide supporting structure contains and transmits the microwave energy while also providing the basic structural foundation of the phased array antenna. The antenna of the present invention significantly reduces fabrication and maintenance cost through its inherent modular design. Also, the antenna of the present invention significantly reduces the number of antenna wire interconnections.

While the invention has been described above with respect to its preferred embodiments, it should be understood that other forms and embodiments may be made without departing from the spirit and scope of the invention.

I claim:

1. A modular integrated multielement phased array antenna comprising:

(a) a supporting structure having a plurality of slotted, ridged waveguide radiator elements longitudinally extending therein;

(b) a single series ridged waveguide feed structure, having a first and second plurality of waveguide channels formed therein, positioned adjacent and supported by at least a portion of said supporting structure for receiving microwave energy from a source and coupling the energy to said first plurality of waveguide channels;

(c) A module, including a plurality of phase shifters, positioned in juxtaposition with said feed structure for receiving the microwave energy from each of said first plurality of waveguide channels and providing the phase shifted microwave energy to each of said second plurality of waveguide channels; and (d) means for coupling the phase shifted energy from each of said second plurality of waveguide channels to each of said waveguide radiator elements, whereby the phase shifted microwave energy in the form of a desired microwave beam pattern is transmitted from said radiator elements to a desired location.

2. A phased array antenna according to claim 1, wherein said single series waveguide feed structure is comprised of a primary arm and a secondary arm.

3. A phased array antenna according to claim 2, wherein said first and second plurality of waveguide channels longitudinally extend within said secondary arm.

4. A phased array antenna according to claim 3, wherein said secondary arm further includes an isolation wall extending traversely between and electromagnetically separating one end of each of said first and second pluralities of waveguide channels.

5. A phased array antenna according to claim 4, wherein said phase shifted energy coupling means is comprised of an integral 180° waveguide bend having a plurality of waveguide sections, wherein each waveguide section is dimensioned to match the ends of a corresponding one said second plurality of waveguide channels and said waveguide radiator elements to couple the phase shifted microwave energy through a 180° shift in direction from each of said second plurality of waveguide channels to each of said waveguide radiator elements.

6. A phased array antenna according to claim 1, wherein each of said phase shifters has an input terminal aligned with one of said first plurality of waveguide channels, and an output terminal aligned with a corresponding one of said second plurality of waveguide channels.

7. A phased array antenna according to claim 6, further comprising a plurality of RF input and output probes.

8. A phased array antenna according to claim 7, wherein each of said RF input probes is connected between one of said first plurality of waveguide channels and an input terminal of one of said phase shifters.

9. A phased array antenna according to claim 7, wherein each of said RF output probes is connected between an output terminal of one of said phase shifters and one of said second plurality of waveguide channels.

* * * * *